US005638916A

United States Patent [19]

Schneider

[11] Patent Number: 5,638,916

[45] Date of Patent: Jun. 17, 1997

[54] LADDER SAFETY ATTACHMENT

[76] Inventor: Richard C. Schneider, 204 Everglades Blvd., Stuart, Fla. 34990

[21] Appl. No.: 685,806

[22] Filed: Jul. 24, 1996

[51] Int. Cl.[6] ..... E06C 7/48

[52] U.S. Cl. ..... 182/206; 182/116

[58] Field of Search ..... 182/116, 206, 182/187, 93

[56] References Cited

U.S. PATENT DOCUMENTS

| | | | |
|---|---|---|---|
| 3,028,929 | 4/1962 | Chubbs | 182/187 X |
| 3,991,853 | 11/1976 | Bridges | 182/187 |
| 4,469,195 | 9/1984 | Sartin | 182/206 |
| 4,730,700 | 3/1988 | Miller | 182/187 |
| 4,742,888 | 5/1988 | Amacker | 182/187 |
| 5,267,632 | 12/1993 | Mintz | 182/116 |
| 5,460,240 | 10/1995 | Jones | 182/116 |

*Primary Examiner*—Alvin C. Chin-Shue
*Attorney, Agent, or Firm*—Kevin Redmond

[57] ABSTRACT

A ladder safety attachment designed to secure a ladder at its top to a tree or pole to prevent rocking or sliding of the ladder out of the position to which the ladder was initially set. The safety attachment includes a platform with two sets of spikes. The spikes in the first set are fixed in position with respect to the platform and are designed to engage a tree or pole as soon as the combined safety attachment and ladder are placed against the pole or tree, holding the ladder in its initial position while an operator ascends the ladder to engage the second set of spikes. The spikes in the second set are adjustable and are designed to accommodate various diameter trees or poles. The safety attachment further includes a adjustable set of ladder attachment brackets which can be adjusted to accommodate ladders of various sizes.

9 Claims, 1 Drawing Sheet

LADDER SAFETY ATTACHMENT

BACKGROUND

1. Field

The present invention relates to devices designed to secure a ladder to a tree or pole to prevent movement of the ladder while an operator is on the ladder.

2. Prior Art

There have been a number of prior art approaches to provide a safe method of securing a ladder to a tree, however, most have proven unwieldy or actually unsafe during the initial attachment phase. For example U.S. Pat. No. 4,469,195 shows a caliper gripping mechanism that uses a pulley and line system to open the calipers to enable them to fit about a tree. A spring's tension is the only force used to drive the calipers into the tree. The spring is stretched widely about relatively large diameter trees and after repeated stretching may lose some of its resiliency, especially when it is used with trees or poles having a relatively small diameter. This problem is made worse by the fact that even initially with a new spring, the tension force produced by the spring varies with the amount it is stretched and tension is relatively less when it is stretched only a relatively short distance, as would be the case with small diameter trees or posts.

In U.S. Pat. No. 4,363,378 the ladders top most rung is curved to accommodate the curvature of a tree or pole. The operator must climb to the top to secures a metal band about the pole. The difficulty encountered with this approach is the curved rung does not prevent the ladder from rotating or sliding about the pole while the operator is in the initial climb to secure the ladder with the metal band.

In U.S. Pat. No. 4,946,004 pivotally mounted caliper gripping arms are forced to enclose a tree by resting the ladder against the tree. There is no locking mechanism which secures the arms about the tree. Wind or a misplacement of weight by the operator can cause the arms to release, resulting in no securing action by this device when it may be most needed. These problems and others are overcome in the present invention, as described below.

SUMMARY

The present invention consists of a platform on which are mounted two sets of spikes for gripping a pole or tree. Brackets for attaching the platform to the ladder are positioned below the platform. The brackets are movable with respect to the platform to accommodate a variety of ladder sizes. The platform includes a semicircular cutout which faces the tree. Located about this semicircular cutout is the first set of spikes which are fixed in position at approximately 15 degrees on either side of the center of the semicircular cutout. The first set of spikes have their sharp ends extending into the cutout area to engage a tree or pole as soon as the ladder is placed against it, thereby preventing any sliding or rotation of the ladder while the operator makes his initial climb. Once up the ladder, the operator can engage the tree with a second set of spikes which are rotatable with respect to the platform, enabling them to engage the sides of the tree or pole. The second set of spikes are locked in position by a clamping mechanism which prevents the second set of spikes from releasing, regardless of wind or the position of the operator on the ladder.

DETAILED DESCRIPTION OF THE INVENTION

Figure 5:
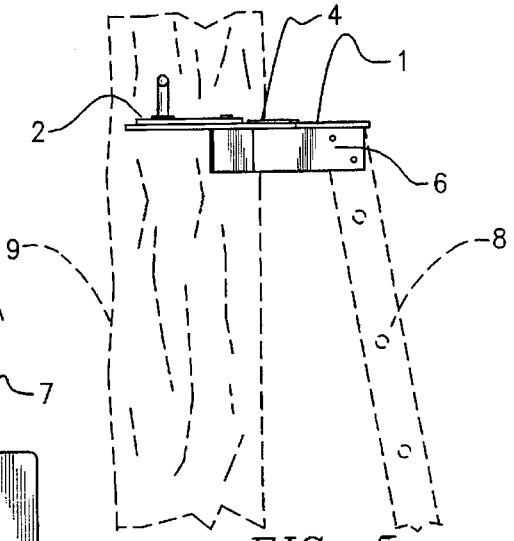
FIG. 5 is a side view of the ladder safety attachment showing it's typical position in use when attaching a ladder to a tree.

The present invention is a ladder safety device designed to secure the top of a ladder to a tree or pole to prevent the ladder from falling away from, or from shifting about a tree or pole under wind pressure or under the weight of an operator and his equipment. To simplify this description, "a pole" will be used to represent a tree, pole, post or other similar item. The ladder safety device is secured to the top of a ladder and then the device is easily secured to a pole as shown in the side view of the invention presented in FIG. 5. In this Figure, it can be seen that a ladder 8 is attached to a left bracket 6 which is connected to a platform 1 of the ladder safety device. A left fixed spike 4 and a left adjustable spike 2 mounted on the platform grip a tree 9 to secure the top of the ladder to the tree by means of the ladder safety device. Although this side view of the invention shows only the left fixed and adjustable spikes, it is understood that a right fixed spike and a right adjustable spike are gripping the tree from the right side of the platform at the same time.

The principal components of the present invention are shown in detail in FIGS. 1 through FIG. 4. The principal components include the platform 1, the left fixed spike 4, the right fixed spike 5, the left adjustable spike 2, the right adjustable spike 3, a left bracket 6 and a right bracket 7. The platform is typically a flat plate of heavy sheet metal such as a plate of 3/16 inch aluminum on which all the main components are mounted including the spikes and the brackets. The platform includes a round cutout area such as a semicircular cutout 1A, on it front side which faces the pole, to aid in gripping a pole. The portions of the platform remaining on either side of the cutout 1A are referred to as the platform ears, designated by drawing numeral 11 for the right ear and by drawing numeral 10 for the left ear. The ears extend outwardly from the platform and about either side of a pole when the safety device is placed in its normal position about a pole. The cutout 1A typically has a radius that is larger than the largest tree expected to be encountered. The fixed spikes 4 and 5 are mounted on the platform by bolts 4B and 5B respectively. Protruding into the cutout area is the pointed ends of the left and fight fixed spikes to engage a tree immediately upon the safety device's being rested on the tree. This feature tends to secure the ladder to the tree prior to the operator's ascending the ladder and thereby provides an initial measure of safety not always present in prior art devices. This is important because in prior art devices, it is often necessary to ascend the ladder in order to accomplish any form of securing of the ladder to the tree. During this initial climb with such prior art devices, the operator could be injured in the fall of an unsecured ladder.

In a preferred embodiment of the present safety device, both the adjustable and fixed spikes are formed of the same heavy sheet metal as the platform, typically 3/16 inch aluminum. The fixed spikes are typically two and three quarter inches by one inch wide and are disposed at an angle of nominally 15 degrees on either side of the center line 12 of the cutout. These fixed spikes protrude into the cut out area a typical distance of three quarters to one inch. The adjustable spikes 2 and 3 are formed with a main plate area 2D and 3D which is triangular or fan shaped. This area is referred to simply as the fan. The sides of the fan intersect to form two upper and one lower angles or corners. On the fan, a spike is located in one upper corner, such as corner 2E or 3E, and a handle, such as 2F or 3F is located in the opposite upper corner. To simply fabrication, the fan, spike and the handle of the adjustable spike are formed from a single piece of sheet material. The adjustable spikes are typically bolted to the platform with a single bolt for each adjustable spike to form a pivot point located near the lower corner of the fan, such as pivot points 2G and 3G, shown in FIG. 4. The handles of the fans are disposed outwardly of the platform, while the spikes are disposed inwardly to grip the pole. The fans are located on the ears of the platform with the spikes projecting inward of the cutout area. There are semicircular slot 2A and 3A located in the left and right fans respectively which typically have a width of five sixteenths of an inch and a radius about the pivot point of two and three quarter inches.

The clamps 2B and 3B are comprised primarily of a handle, such as handle 2B or 3B and a shaft such as shaft 2H or 3H, that are each attached orthogonally to the midpoint of their respective handle. The handles are typically made of rod material which has a circular cross section. The clamps are used to hold the adjustable spikes 2 and 3 respectively in a locked position with respect to the platform, and are mounted to the platform through the slots 2A and 3A in the adjustable spikes by means of threads on the lower end of the clamp shafts 2H and 3H in conjunction with threaded holes 2I and 3I in the platform directly below the slot. The clamps include clamp handles 2J and 3J and flange shaped bearing surfaces 2C and 3C that are located directly above the threads on the clamp shafts 2H and 3H. When a clamp is threaded down into the platform, the bearing surface is pressed against the adjustable spike on either side of the slot holding the adjustable spike in its position against a pole. To engage an adjustable spike into a pole, the adjustable spike is moved by means of the adjustable spike handles, 2F or 3F, to make contact with the pole. The adjustable spikes can be manually positioned as desired by rotating them about their respective pivot points. Once sufficient engagement has been obtained, the clamps are turned down, locking the adjustable spikes in position and holding the ladder to the pole regardless of wind or other disturbances to the ladder.

Figure 6:
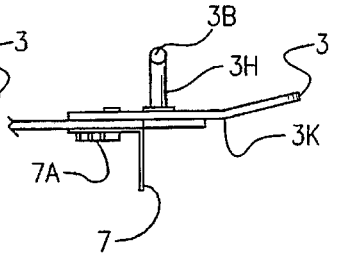
FIG. 6 is a side view of an alternative form of adjustable spike handle used to help the hands clear the platform when engaging a small pole.

FIG. 6 shows an alternative form of the adjustable spikes. For illustrative purposes, only the fight adjustable spike is shown in FIG. 6; however, it is understood that both left and right adjustable spikes can be adapted to conform to the configuration for the handles shown in FIG. 6. The difference between the standard right adjustable spike handle 3 shown in FIG. 2 and the alternative configuration shown in FIG. 6 is an upward bend in the handle as it extends beyond the platform The upward bend can be seen to start at point 3K and makes an angle of nominally 15 degrees with the horizontal plane, although an angle of between 10 and 30 degrees is acceptable.

The purpose of this bend is provide improved comfort and safety for the operator, especially when engaging a small diameter pole. In such an instance, the handle can be expected to be pushed forward over the ears of the platform to grip the pole, making it possible to pinch the operators hand between the handle and the platform when using the standard configuration handle. Providing the upward bend in the adjustable spike handle as shown in FIG. 6 makes it possible to more easily grip the handles, clear the platform and avoid injury to the operator's hands.

Figure 1:
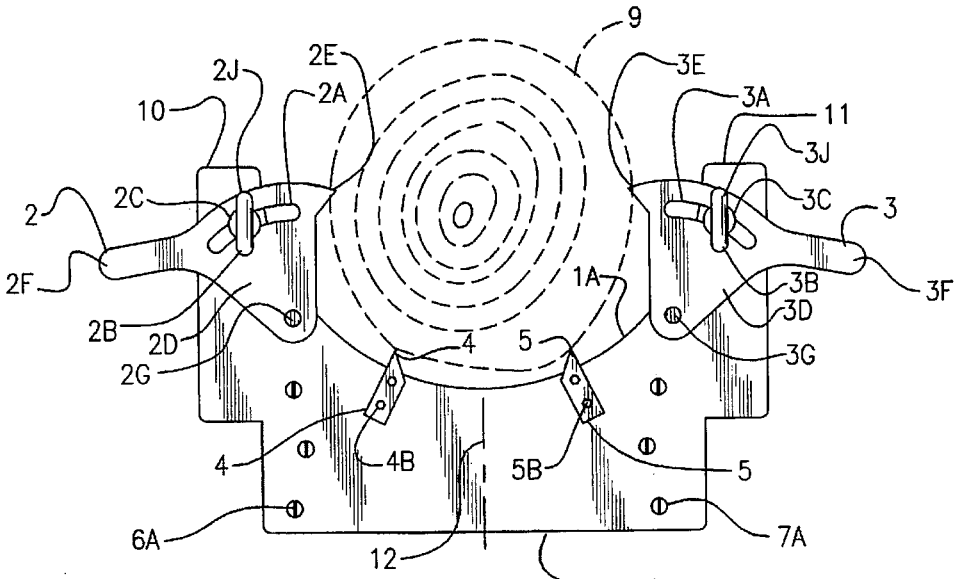
FIG. 1 is a view of the ladder safety attachment, showing a main platform with a set of fixed and a set of adjustable spikes securely engaging a tree.
Figure 2:
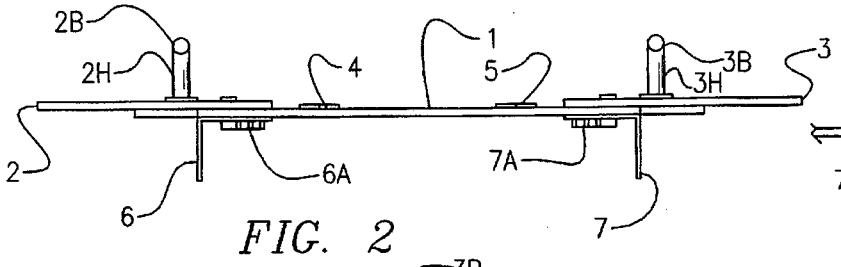
FIG. 2 is a rear view of the ladder safety attachment showing clamps used to lock the adjustable spikes in position against a tree or pole and brackets located beneath the platform used to connect the safety attachment to the top of a ladder.
Figure 4:
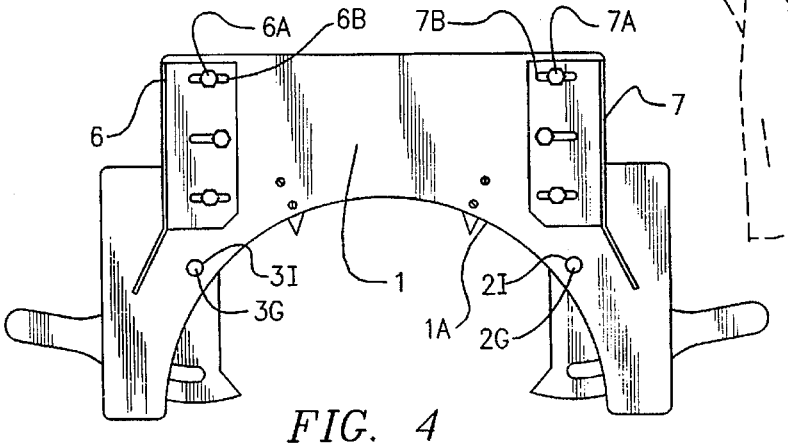
FIG. 4 is bottom view of the ladder safety attachment showing the brackets and the slotted holes used for lateral adjustment of the brackets to accommodate various sizes of ladders.

As can be seen in FIGS. 2 and 4, there are two brackets 6 and 7 located beneath the platform. These brackets are secured to the platform by bolts such as 6A and 7A which are passed through slotted holes, such as holes 6B and 7B placed in brackets 6 and 7 respectively. These slotted holes are designed to permit the brackets to slide laterally with respect to the platform to accommodate various sizes of ladders. Once the desired spacing for a particular ladder is found, the brackets are clamped in place by tightly securing the bolts 6A and 7A to the platform.

Figure 3:
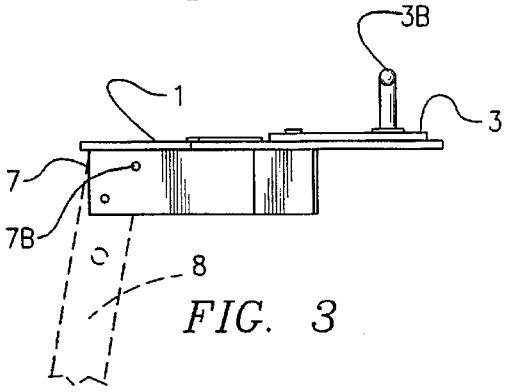
FIG. 3 is a side view of the ladder safety attachment, showing the right side of the platform, the fight bracket and the right clamp.

In FIG. 3, bracket 7 is shown attached to ladder 8 by means of a bolt 7C. The top of the ladder is secured to the brackets by placing the bolt 7C through the left end of bracket 7. The opposite side of the ladder is similarly attached to bracket 6.

As is evident to those skilled in the art, many variations of the present invention are possible, but such variations which do not depart the spirit of the invention remain included within the scope of the invention The invention is limited only by the following appended claims.

As can be seen in FIGS. 2 and 4, there are two brackets 6 and 7 located beneath the platform. These brackets are secured to the platform by bolts such as 6A and 7A which are passed through slotted holes, such as holes 6B and 7B placed in brackets 6 and 7 respectively. These slotted holes are designed to permit the brackets to slide laterally with respect to the platform to accommodate various sizes of ladders. Once the desired spacing for a particular ladder is found, the brackets are clamped in place by tightly securing the bolts 6A and 7A to the platform.

In FIG. 3, bracket 7 is shown attached to ladder 8 by means of a bolt 7C. The top of the ladder is secured to the brackets by placing the bolt 7C through the left end of bracket 7. The opposite side of the ladder is similarly attached to bracket 6.

As is evident to those skilled in the art, many variations of the present invention are possible, but such variations which do not depart the spirit of the invention remain included within the scope of the invention. The invention is limited only by the following appended claims. Having described my invention,

I claim:

1. A ladder safety attachment of the type that can be attached to the top of the ladder to secure the top of the ladder to a pole in order to prevent movement of the ladder while it supports an operator, comprising:

(a) a platform, said platform being in the form of a generally plainer surface and having a curved cutout area on a side designed to face said pole, said cutout area being generally symmetrical and evenly disposed about a center line of the curved cutout area, (b) a fixed spike mounted on the platform, said fixed spike being disposed at a first angle on a side away from of the center line of said curved cutout area with the pointed end of said spike extending outwardly of the platform beyond the edge of said curved cutout area to engage said pole, (c) an adjustable spike being disposed at a second angle that is larger than said first angle on a side away from of the center line of said curved cutout area, said adjustable spike including a rotatable mounting to said platform, and said adjustable spike being rotatable adjustable about said rotatable mounting with the pointed end of said adjustable spike directed towards said cutout area to enable said adjustable spike to be adjusted to the diameter of said pole and to accommodate and engage various size poles, and said adjustable spike further including means for manually adjusting said spike in position to aid in engaging said spike with said pole, and (d) clamping means connected to said platform to hold said adjustable spike in a selected position with respect to said platform.

2. A ladder safety attachment as claimed in claim 1, wherein said adjustable means for attachment of said platform to a ladder includes two brackets for attachment to both sides of said ladder, said brackets being slideable mounted to said platform to accommodate various sizes of ladders, and said brackets further including means for attachment of said brackets to said ladder.

3. A ladder safety attachment as claimed in claim 1, wherein said clamping means include a clamp handle to mm said clamping means by hand, a shaft attached at one end to said clamp handle, said shaft having a threaded end located at the second end of said shaft opposite the end connected to the clamp handle, said threaded end of said shaft being threaded into said platform proximate the location of said adjustable spike, and said clamping means further including a flange positioned about said shaft above and proximate the threaded end of said shaft, said flange extending over a portion of said adjustable spike to serve as a bearing surface to apply pressure against said adjustable spike as said clamping means is turned down into said platform by means of said threaded end of said shaft for securing said adjustable spike in a selected position.

4. A ladder safety attachment as claimed in claim 3, wherein said adjustable spike is formed of a flat plate, said flat plate including a slot sufficiently wide to pass without interference the shaft of said clamping means, and sufficiently narrow to enable a portion of said flange to remain above and over a portion of said adjustable spike while said adjustable spike is rotated about its rotatable mounting to said platform and said slot generally describing an arc of constant radius about said rotatable mounting of said adjustable spike.

5. A ladder safety attachment as claimed in claim 4, wherein said means for manually adjusting the position of said adjustable spike further includes an adjustable spike handle attached to said adjustable spike and disposed outwardly of said platform and generally away from said cutout area for manually gripping and rotating said adjustable spike into engagement with said pole.

6. A ladder safety attachment as claimed in claim 5, wherein said adjustable spike and said adjustable spike handle are formed of a single sheet of flat plate material and said adjustable spike handle extends out beyond said platform in a generally horizontal direction when said platform is held in a generally horizontal plane.

7. A ladder safety attachment as claimed in claim 6, wherein said adjustable spike handle is bent upwards with respect to the remainder of the adjustable spike to form an angle of between 10 and 30 degrees with the horizontal plane when said remainder of said adjustable spike is held in the horizontal plane to enable said adjustable spike handle to clear said platform when engaging a pole.

8. A ladder safety attachment as claimed in claim 4 wherein said flange extends over said slot on both sides of said slot and bears against said adjustable spike when said clamping means is threaded down into said platform to secure said adjustable spike in a selected position with respect to said platform.

9. A ladder safety attachment as claimed in claim 2, wherein said slidable mounting include lateral slots in said brackets and said slideable mounting further including bolts having bolt heads wider than said slots with the bolt shanks passing through said lateral slots for threading said bolts into said platform to enable said brackets to slide laterally to a desired separation between brackets and secure said brackets in place with respect to said platform by threading said bolts into said platform and tightening the bolt heads against said brackets.

* * * * *